US010660411B2

(12) United States Patent
Bessho

(10) Patent No.: US 10,660,411 B2
(45) Date of Patent: May 26, 2020

(54) BUCKLE OF A BELT

(71) Applicant: Nobuyori Bessho, Nishinomiya (JP)

(72) Inventor: Nobuyori Bessho, Nishinomiya (JP)

( * ) Notice: Subject to any disclaimer, the term of this patent is extended or adjusted under 35 U.S.C. 154(b) by 0 days.

(21) Appl. No.: 16/416,821

(22) Filed: May 20, 2019

(65) Prior Publication Data

US 2019/0357635 A1 Nov. 28, 2019

(30) Foreign Application Priority Data

May 24, 2018 (JP) ..... 2018-099886

(51) Int. Cl.
*A44B 11/12* (2006.01)

(52) U.S. Cl.
CPC ..... *A44B 11/12* (2013.01); *A44D 2203/00* (2013.01)

(58) Field of Classification Search
CPC ..... A44B 11/12; A44D 2203/00
See application file for complete search history.

(56) References Cited

U.S. PATENT DOCUMENTS 1,385,865 A * 7/1921 Czerwinski ..... A44B 11/12 24/191
1,604,747 A * 10/1926 Freysinger ..... A44B 11/28 24/312
1,631,104 A * 5/1927 Matteson ..... A44B 11/12 24/191
2,862,268 A * 12/1958 Cushman ..... B64D 17/32 24/323
2,964,815 A * 12/1960 Sereno ..... A44B 11/2557 24/323
4,733,440 A * 3/1988 Ogawa ..... A44B 11/06 24/170
5,735,023 A * 4/1998 Smith ..... A44B 11/006 24/163 K
5,832,573 A * 11/1998 Howell ..... A44B 11/2526 24/664
6,098,859 A * 8/2000 Bortner ..... A44B 11/12 224/195
D739,784 S 9/2015 Bessho
(Continued)

FOREIGN PATENT DOCUMENTS

JP 2014-128529 7/2014
JP 2018-82964 5/2018

OTHER PUBLICATIONS

U.S. Appl. No. 29/630,995, filed Dec. 26, 2017, Nobuyori Bessho.

*Primary Examiner* — Robert Sandy
*Assistant Examiner* — David M Upchurch
(74) *Attorney, Agent, or Firm* — Oblon, McClelland, Maier & Neustadt, L.L.P.

(57) ABSTRACT

According to one aspect of the present invention, a buckle for a clothing belt includes a first rotating body supported by the first shaft so as to be rotatable, an open end portion of the first rotating body being capable of being disposed between a bar and a back plate of a base body by making a first shaft slid; and a second rotating body supported by a second shaft so as to be rotatable with the second shaft as a fulcrum, formed so as to have a second convex portion, and capable of hindering a movement of the first rotating body in a direction opposite to the bar side with the second convex portion in a state where the second convex portion is rotated so as to be pushed in toward the opening portion of the back plate.

6 Claims, 4 Drawing Sheets

(56) References Cited

U.S. PATENT DOCUMENTS

| | | | | |
|---|---|---|---|---|
| 2010/0115737 | A1* | 5/2010 | Foubert | A44B 11/2526 24/164 |
| 2013/0185902 | A1* | 7/2013 | Kaneko | A44B 11/12 24/324 |
| 2015/0013115 | A1* | 1/2015 | Shirai | A44B 11/223 24/191 |

* cited by examiner

BUCKLE OF A BELT

CROSS-REFERENCE TO RELATED APPLICATION

This application is based upon and claims the benefit of priority from prior Japanese Patent Application No. 2018-099886 filed on May 24, 2018 in Japan, the entire contents of which are incorporated herein by reference.

BACKGROUND OF THE INVENTION

Field of the Invention

Embodiments relate to a buckle for a clothing belt and, more particularly, to a buckle for a clothing belt with which a belt length fixing position can be steplessly adjusted at a time of mounting.

Related Art

At present, various types of buckles are commercially available as buckles for clothing belts with which a belt length fixing position can be steplessly adjusted at a time of mounting. Examples of how to use a leather-only belt, in particular, include passing the belt through two slits in a buckle and performing fixing by generating a frictional force between the belt and the buckle by means of the tension that the belt receives. However, the structure in which the belt is fixed by the frictional force being generated between the belt and the buckle by means of the tension that the belt receives entails a problem in that the belt is likely to loosen in a case where the buckle receives an external force other than the tension.

BRIEF SUMMARY OF THE INVENTION

According to one aspect of the present invention, a buckle for a clothing belt includes:

a base body including a back plate in which an opening portion is formed, a first side plate connected to one of two facing sides of the back plate, a second side plate connected to another one of the two facing sides of the back plate, and a bar extending from one side of the first and second side plates to the other side of the first and second side plates at a position away from the opening portion with a clearance from a plate surface of the back plate;

a first shaft disposed between the first and second side plates and supported by the first and second side plates so as to be slidable toward a direction orthogonal to an axial direction;

a first rotating body supported by the first shaft so as to be rotatable with the first shaft as a fulcrum and formed so as to have a first convex portion, an open end portion of the first rotating body on a side opposite to a side supported by the first shaft being capable of being disposed between the bar and the back plate by making the first shaft slid to the bar side in a state where the first convex portion is rotated toward the opening portion of the back plate;

a second shaft disposed between the first and second side plates and supported by the first and second side plates; and a second rotating body supported by the second shaft so as to be rotatable with the second shaft as a fulcrum, formed so as to have a second convex portion, and capable of hindering a movement of the first rotating body in a direction opposite to the bar side with the second convex portion in a state where the second convex portion is rotated so as to be pushed in toward the opening portion of the back plate, wherein an end portion of a clothing belt is fixed to the back plate on the bar side so as to straddle the opening portion, the clothing belt is disposed so as to be passed through the base body in a state of being overlapped in two, the open end portion of the first rotating body is moved to a space between the bar and the clothing belt by making the first shaft slid to the bar side in a state where the clothing belt overlapped in two is bent so as to be pushed out from the opening portion by the first convex portion as a result of rotation of the first rotating body, a movement of the first rotating body in a direction opposite to the bar side is restrained by making a force against rotation of the second rotating body apply in a state where the second rotating body is rotated until the second convex portion of the second rotating body is positioned on a path of movement of a shaft side end portion of the first rotating body that moves with a sliding of the first shaft, with the first convex portion in close contact with a surface of the clothing belt and the open end portion of the first rotating body in close contact with a surface of the clothing belt, the clothing belt is fixed by a restraint on a movement of the first rotating body in the direction opposite to the bar side, the restraint on the movement of the first rotating body in the direction opposite to the bar side is released by making the second rotating body rotate to an opposite side, the open end portion of the first rotating body is pulled out from the space between the bar and the clothing belt by making the first shaft slid in the direction opposite to the bar side, and the fixing of the clothing belt is released by making the first rotating body rotate in a direction opposite to a direction in which the clothing belt overlapped in two is pushed out from the opening portion by the first convex portion.

According to another aspect of the present invention, a buckle for a clothing belt includes:

a base body including a back plate in which an opening portion is formed, a first side plate connected to one of two facing sides of the back plate, and a second side plate connected to another one of the two facing sides of the back plate;

a first shaft disposed between the first and second side plates and supported by the first and second side plates so as to be slidable toward a direction orthogonal to an axial direction;

a second shaft disposed between the first and second side plates and supported by the first and second side plates at a position away from the opening portion with a clearance from a plate surface of the back plate;

a first rotating body supported by the first shaft so as to be rotatable with the first shaft as a fulcrum and formed so as to have a first convex portion, an open end portion of the first rotating body on a side opposite to a side supported by the first shaft being capable of being disposed between the second shaft and the back plate by making the first shaft slid to the second shaft side in a state where the first convex portion is rotated toward the opening portion of the back plate; and a second rotating body supported by the second shaft so as to be rotatable with the second shaft as a fulcrum, formed so as to have a second convex portion, and capable of hindering a movement of the first rotating body in a direction opposite to the second shaft side with the second convex portion in a state where the second rotating body is rotated so as to push the second convex portion in toward the opening portion of the back plate, wherein an end portion of a clothing belt is fixed to the back plate on the second shaft side so as to straddle the opening portion, the clothing belt is disposed so as to be passed through the base body in a state of being overlapped in two, the open end portion of the first rotating body is moved to a space between the second shaft and the clothing belt by making the first shaft slid to the second shaft side in a state where the clothing belt overlapped in two is bent by the first convex portion so as to be pushed out from the opening portion as a result of rotation of the first rotating body, a movement of the first rotating body in the direction opposite to the second shaft side is restrained by making a force against rotation of the second rotating body apply in a state where the second rotating body is rotated until the second convex portion of the second rotating body is positioned on a path of movement of a shaft side end portion of the first rotating body that moves with a sliding of the first shaft, with the first convex portion in close contact with a surface of the clothing belt and the open end portion of the first rotating body in close contact with a surface of the clothing belt, the clothing belt is fixed by a restraint on a movement of the first rotating body in the direction opposite to the second shaft side, the restraint on the movement of the first rotating body in the direction opposite to the second shaft side is released by making the second rotating body rotate to the opposite side, the open end portion of the first rotating body is pulled out from the space between the second shaft and the clothing belt by making the first shaft slid to the direction opposite to the second shaft side, and the fixing of the clothing belt is released by making the first rotating body rotate in a direction opposite to a direction in which the clothing belt overlapped in two is pushed out from the opening portion by the first convex portion.

DETAILED DESCRIPTION OF THE INVENTION

Figure 1:
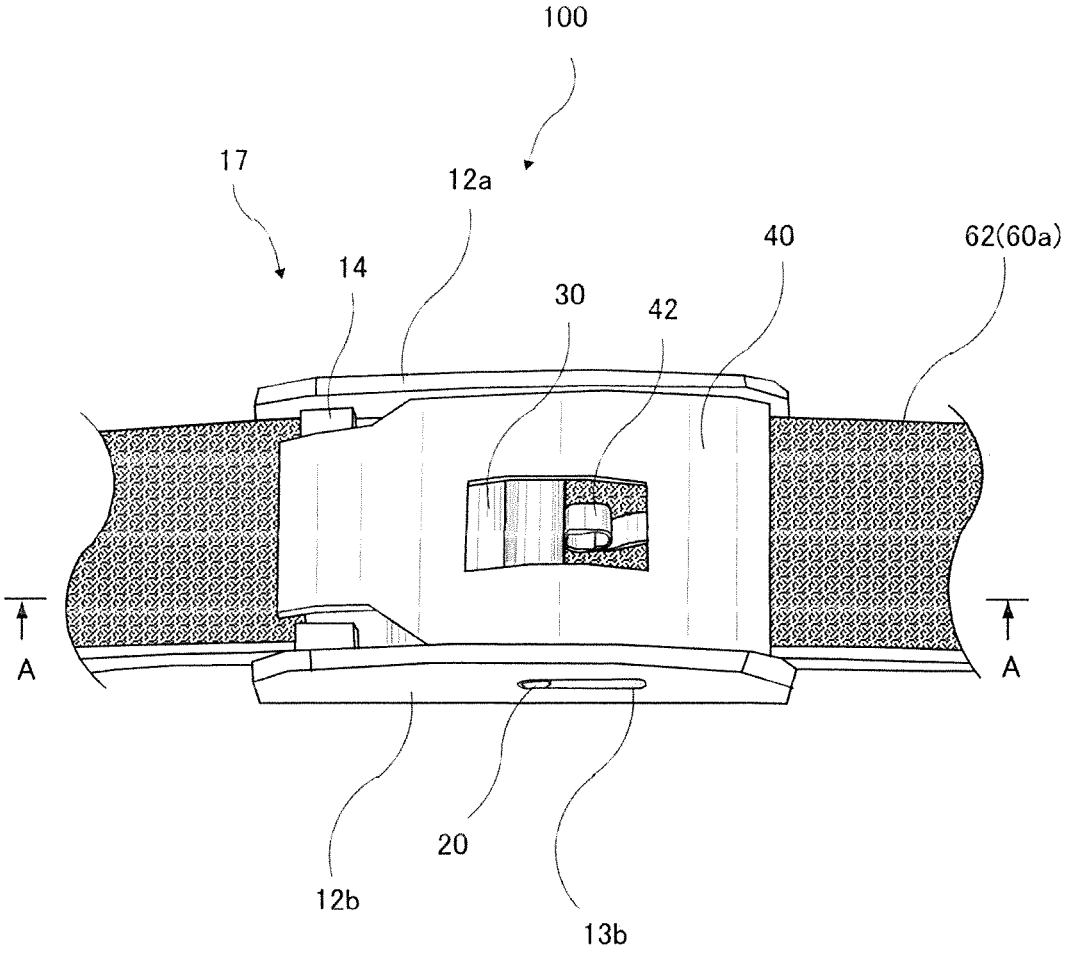
FIG. 1 is a perspective view as viewed from a front direction, which illustrates an example of the configuration of a buckle for a clothing belt according to Embodiment 1.

The applicant previously filed JP patent application (as disclosed in JP-A-2014-128529) regarding a buckle, in which the distal end portion that is the opposite side of a belt where an end portion is fixed to a bottom plate in the buckle is inserted into the buckle from the opposite side pulled out from the buckle and horizontally passed so as to be overlapped on the fixed end portion. Subsequently, a rotatable clasp having an end side supported by a base body of the buckle is used so that the overlapped two-stage belt is pressed so as to project from the back surface of the buckle toward a human body side. After the pressing, the clasp is slid so that the other end side of the clasp is inserted into the base body of the buckle and a hook portion on the other end side is hooked onto the base body of the buckle at the insertion point so that the clasp is fixed. The buckle is to solve the problem that a belt loosens due to an external force other than tension.

According to the previous patent application, the hook portion on the other end side of the clasp needs to be inserted into the base body of the buckle, and thus a clearance considering the thickness of the hook portion is required for the space between the overlapped two-stage belt and the base body of the buckle. Accordingly, a clearance that is equivalent to the thickness of the clasp at the least needs to be provided between the belt and the base body of the buckle for passage of the hook portion that is provided in the other end portion of the clasp, and no frictional force can be effectively generated from a close contact between the clasp and the belt. Elimination of the hook portion leads to an unintentional shift of the clasp and belt loosening.

In addition, according to the applicant's previous patent application, the structure of the entire buckle having the rotating clasp entails a significant heterogeneous impact on design, which did not exist before. Accordingly, the structure is not suitable for business clothes and ceremonial dresses, which is regarded as another problem.

Provided in the following embodiments is a buckle with which it is possible to fix a belt with a strong frictional force and the belt does not loosen as a result of an unintentional clasp shift.

In the following embodiments, the state of the buckle seen from the front toward a user in a state where, for example, the free end of the belt is generally on a left front side with the belt mounted on the user's body will be described as a front view. Likewise, the state of the buckle seen from the bottom surface side in a state where, for example, the belt is mounted on the user's body will be described as a bottom view. Likewise, a state where the state that the front view illustrates is reversed will be described as a rear view.

It is preferable to use a metal material, fiber reinforced plastics (FRP), or an engineering plastic material as a material of each component of the buckle described below. More desirably, a metal material is preferable. In a case where a metal is used, for example, iron, stainless steel, titanium, aluminum, silver, copper, nickel, chromium, zinc, tin, magnesium, an alloy of the metals, or the like is preferable. Although the following description assumes a case where a metal material is used, "welding" may be read as "adhesion" in a case where a plastic material or the like is used. Likewise, in a case where a plastic material or the like is used, "manufacturing by bending" may be read as "manufacturing into a bent shape".

As for the shaft in the following description, a rotating body rotates around the shaft in a case where the shaft is fixed to a base body and the shaft rotates in the base body in a case where the shaft is fixed to the rotating body.

Embodiment 1

FIG. 1 is a perspective view as viewed from the front direction, which illustrates an example of the configuration of a buckle for a clothing belt according to Embodiment 1. The rotating body rotates around the shaft in a case where the shaft is fixed to the base body and the shaft rotates in the base body in a case where the shaft is fixed to the rotating body.

Figure 2A:
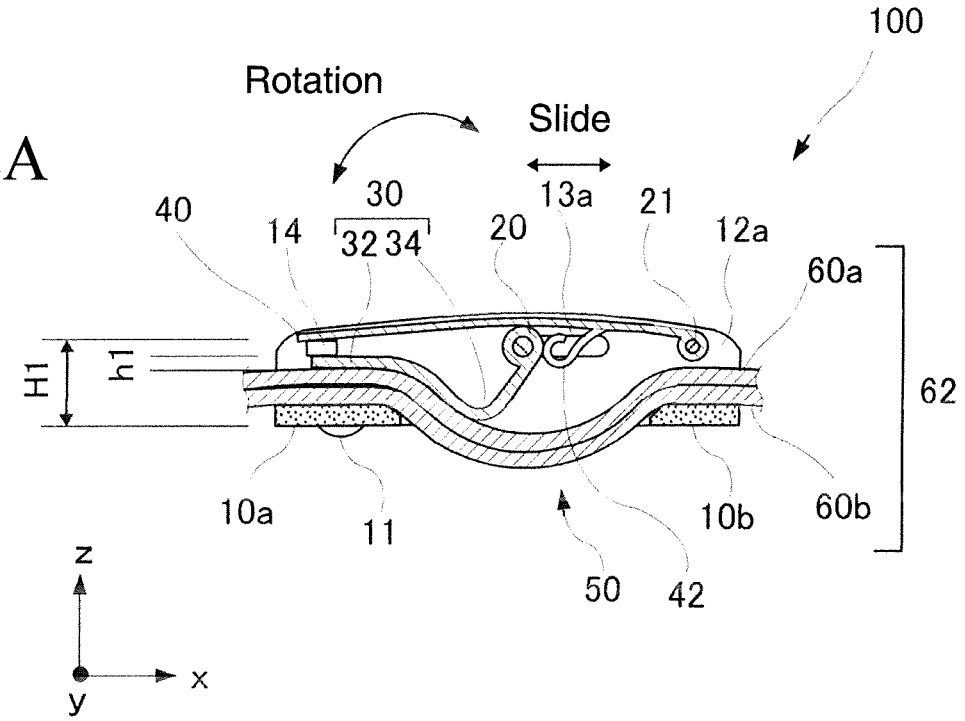
FIG. 2A is a diagram illustrating an example of the cross-sectional configuration of the buckle for a clothing belt according to Embodiment 1 as viewed from a bottom surface direction.
Figure 2B:
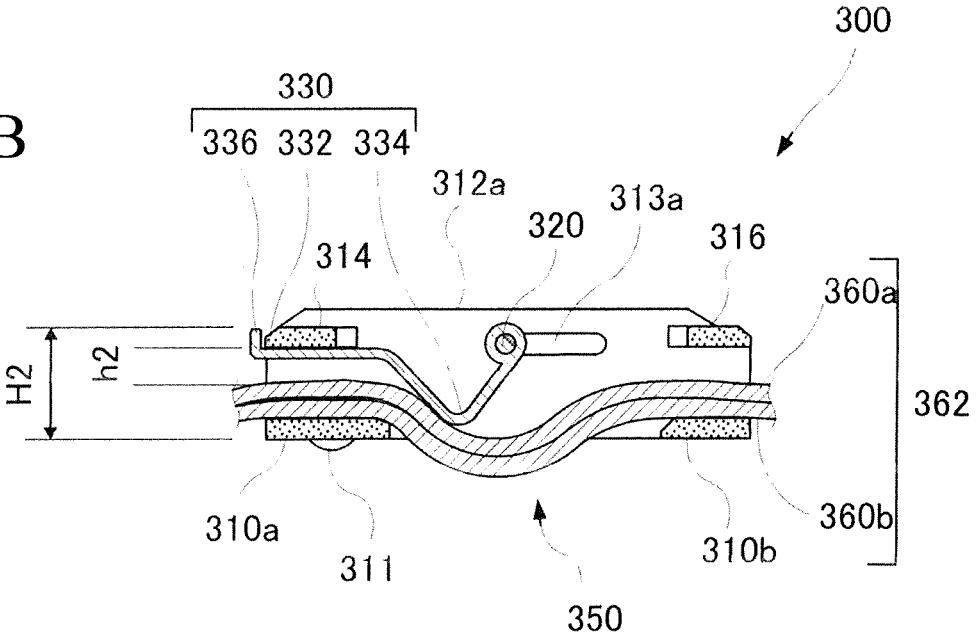
FIG. 2B is a diagram illustrating an example of the cross-sectional configuration of a buckle for a clothing belt according to a first comparative example as viewed from the bottom surface direction.

FIG. 2A is a diagram illustrating an example of the cross-sectional configuration of the buckle for a clothing belt according to Embodiment 1 as viewed from the bottom surface direction. FIG. 2B is a diagram illustrating an example of the cross-sectional configuration of a buckle for a clothing belt according to a first comparative example as viewed from the bottom surface direction. Illustrated in FIG. 2A is a cross section of the buckle for a clothing belt according to Embodiment 1. Illustrated in FIG. 2B is a cross section of the first comparative example, in which the other end side of a clasp of the buckle for a clothing belt corresponding to FIG. 2A is inserted into the base body of the buckle and the clasp is fixed by hooking onto the base body of the buckle where a hook portion on the other end side is inserted.

In FIGS. 1 and 2A, a buckle 100 for a clothing belt (hereinafter, referred to as the buckle 100) is provided with a base body 17 of the buckle having a back plate 10 (10*a* and 10*b*), side plates 12*a* and 12*b*, and a bar 14, a shaft 20 (first shaft), a belt clasp 30, a shaft 21 (second shaft), and a clasp fixture 40. A slit 50 (opening portion) is formed between portions 10*a* and 10*b* of the back plate 10, in the back plate 10. The slit 50 is opened with a width larger than the width of a clothing belt 62 (hereinafter, referred to as the belt 62). The slit 50 opens with a length of, for example, 25 to 40 mm in the longitudinal direction of the belt 62.

The side plate 12*a* is connected to the one of two facing sides of the back plate 10 that are along the back plate 10 end in the width direction of the belt 62. The side plate 12*b* is connected to another one of the two facing sides of the back plate 10. In the example of FIG. 1, the side plate 12*a* (first side plate) is connected to the upper end (upper surface side in FIG. 1) of the back plate 10 in the width direction of the belt 62. The side plate 12*b* (second side plate) is connected to the lower end (lower surface side in FIG. 1) of the back plate 10 in the width direction of the belt 62. The side plates 12*a* and 12*b* and the back plate 10 can be manufactured by casting or the like although the side plates 12*a* and 12*b* and the back plate 10 may be manufactured by the same plate material being bent.

Alternatively, the side plates 12*a* and 12*b* and the back plate 10 may be manufactured separately and connected by welding or the like. The belt 62 is passed between the side plates 12*a* and 12*b*, and thus the clearance between the side plates 12*a* and 12*b* is formed so as to have a size slightly larger than the width of the belt 62. For example, it is preferable that the clearance between the side plates 12*a* and 12*b* is formed such that the size of the clearance exceeds the width of the belt 62 by approximately 1 mm.

The shaft 20 is disposed between the side plates 12*a* and 12*b*. The shaft 20 is supported by the side plates 12*a* and 12*b* so as to be slidable toward a direction orthogonal to an axial direction. Accordingly, slits 13*a* and 13*b* are formed in the longitudinal direction of the belt 62 in the side plates 12*a* and 12*b*. The slits 13*a* and 13*b* may be formed so as to have a width slightly larger than the diameter of the shaft 20. For example, it is desirable that the diameter of the shaft 20 is approximately 2 to 4 mm. Preferably, the width of the slits 13*a* and 13*b* exceeds the diameter of the shaft 20 by approximately 0.1 mm.

In one end portion of the side plates 12*a* and 12*b* (left end portion in the example of FIG. 1), the bar 14 is disposed so as to extend from one side of the side plates 12*a* and 12*b* to the other side of the side plates 12*a* and 12*b*. The bar 14 may interconnect the side plates 12*a* and 12*b*. The bar 14 may be shaped so as to protrude up to halfway from the side plate 12*a* toward the side plate 12*b*. The bar 14 may be shaped so as to protrude up to halfway from the side plate 12*b* toward the side plate 12*a*. The bar 14 may have a plurality of projection shapes in which, for example, the bar 14 protrudes up to halfway from the side plate 12*a* toward the side plate 12*b* and protrudes up to halfway from the side plate 12*b* toward the side plate 12*a*. The example of FIGS. 1 and 2A illustrates the plurality of projection shapes in which, for example, the bar 14 protrudes up to halfway from the side plate 12*a* toward the side plate 12*b* and protrudes up to halfway from the side plate 12*b* toward the side plate 12*a*. The bar 14 is disposed with a clearance from the plate surface of the back plate 10. Although the bar 14 may be connected to the side plates 12*a* and 12*b* by welding or the like, the bar 14 may be integrally manufactured by casting or the like. The bar 14 extends from one side of the side plates 12*a* and 12*b* to the other side of the side plates 12*a* and 12*b* at a position away from the slit 50 with a clearance from the plate surface of the back plate 10.

The belt clasp 30 (first rotating body) is supported by the shaft 20 so as to be rotatable with the shaft 20 as a fulcrum. The belt clasp 30 is supported by the shaft 20 between the side plates 12*a* and 12*b*. The belt clasp 30 is formed so as to have a convex portion 34 (first convex portion) that becomes convex to the back plate 10 side (back side) in a case where the belt clasp 30 is rotated to the bar 14 side. The belt clasp 30 is configured such that an open end portion 32 of the belt clasp 30 on the side opposite to the side supported by the shaft 20 can be disposed between the bar 14 and the back plate 10 (10*a*) by the shaft 20 being slid to the bar 14 side in a state where the convex portion 34 is rotated toward the slit 50 of the back plate 10.

The shaft 21 is disposed between the side plates 12*a* and 12*b*. The shaft 21 is supported by the side plates 12*a* and 12*b*. Unlike the shaft 20, the shaft 21 does not slide. In the example of FIG. 2A, the shaft 21 is supported by the side plates 12*a* and 12*b* at a position on the side opposite to the bar 14 with respect to the slit 50. Desirably, the diameter of the shaft 21 is, for example, approximately 2 to 4 mm.

The clasp fixture 40 (second rotating body) is supported by the shaft 21 so as to be rotatable with the shaft 21 as a fulcrum. The clasp fixture 40 is supported by the shaft 21 between the side plates 12*a* and 12*b*. The clasp fixture 40 is formed so as to have a convex portion 42 (second convex portion) that becomes convex to the back plate 10 side (back side) in a case where the clasp fixture 40 is rotated to the bar 14 side. The clasp fixture 40 is configured such that a movement of the belt clasp 30 in the direction opposite to the bar 14 side can be hindered by the convex portion 42 in a state where the convex portion 42 is rotated so as to be pushed in toward the slit 50 of the back plate 10.

As illustrated in FIGS. 1 and 2A, a belt portion 60*b* of one end side of the belt 62 is fixed with a set screw 11 to the back plate 10*a* on the bar 14 side with respect to the slit 50 such that the belt 62 passes through the base body 17 of the buckle. A belt portion 60*a* of the other end side of the belt 62 is inserted from the space between the bar 14 and the back plate 10 and passed through the base body 17 of the buckle above the back plate 10. As a result, the belt 62 is overlapped in two (back side belt portion 60*b* and front side belt portion 60*a*) in the base body 17 of the buckle. The set screw 11 may be replaced with another fixing method such as a rivet.

At this stage, the length of the belt is adjusted so as to fit a user's waist circumference. Then, with the belt 62 overlapped in two, the belt clasp 30 is tilted and the convex portion 34 is pushed in toward the slit 50. Then, the shaft 20 is slid once in the direction opposite to the bar 14 side in a slit 13 (slit 13*a* being illustrated as a cross section pertains here) of a side plate 12 (side plate 12*a* as a cross section pertains here). Then, the open end portion 32 is pushed in downward from the bar 14, the part of the belt 62 overlapped in two is pushed out from the slit 50 by the convex portion 34, and then the shaft 20 is slid in the slit 13 (slit 13*a* being illustrated as a cross section pertains here) of the side plate 12 (side plate 12*a* as a cross section pertains here) to the bar 14 side in that state. In other words, the open end portion 32 of the belt clasp 30 is moved to the space between the bar 14 and the belt 62 by the shaft 20 being slid to the bar 14 side in a state where the belt 62 overlapped in two by the convex portion 34 is bent so as to be pushed out from the slit 50 as a result of rotation of the belt clasp 30. In other words, the belt clasp 30 is disposed so as to be capable of rising and falling around the shaft 20 perpendicular to the pair of side plates 12*a* and 12*b*. The convex portion 34 has a configuration in which the overlapped belt 62 becomes convex by, for example, 3 mm to 10 mm toward the slit 50 formed between the back plates 10*a* and 10*b* when the belt clasp 30 is tilted and the open end portion 32 of the belt clasp 30 is moved to the space between the bar 14 and the back plate 10*a* by the shaft 20 being slid to the bar 14 side. In other words, the open end portion 32 of the belt clasp 30 is moved so as to be capable of being disposed between the bar 14 and the belt portion 60*a* of the belt 62.

Next, in a state where the clasp fixture 40 is rotated until the convex portion 42 of the clasp fixture 40 is positioned on the path of the movement of the shaft side end portion of the belt clasp 30 that moves with the sliding of the shaft 20 with the convex portion 34 of the belt clasp 30 in close contact with the surface of the belt 62 and the open end portion 32 of the belt clasp 30 in close contact with the surface of the belt 62, a force against the rotation of the clasp fixture 40 is applied, and then the belt 62 is fixed by a movement of the belt clasp 30 in the direction opposite to the bar 14 side being restrained. In the example of FIGS. 1 and 2A, the clasp fixture 40 is rotated such that the convex portion 42 of the clasp fixture 40 is further pushed in while abutting the convex portion 42 against the shaft side end portion of the belt clasp 30 that moves with the sliding of the shaft 20, and thus fixing (engagement) is performed by elastic deformation and a force against reverse rotation of the clasp fixture 40 is applied. As a result, the belt 62 is fixed by a movement of the belt clasp 30 in the direction opposite to the bar 14 side being restrained. In other words, the clasp fixture 40 rotatably supported by the shaft 21 is rotated so as to cover the belt clasp from above, the convex portion 42 of the clasp fixture 40 formed of an elastic body is inserted beside the clasp, and the convex portion 42 is pushed into and engaged with the shaft side end portion of the belt clasp.

In the example of FIGS. 1 and 2A, the clasp fixture 40 performs covering so as to cover the base body 17 of the buckle with a clearance allowing entering of a user's finger provided between the belt portion 60*a* of the belt 62 and the end portion on the side that is opposite to the shaft 21. As a result, it is possible to achieve an appearance suitable for business clothes and ceremonial dresses and achieve a design of completely original appearance by covering a lid from above the clasp that is unique in appearance also in the buckle for rotatable clasp-based belt fixing. Although a case where a window portion is provided in the vicinity of the middle or/and a case where most of the inside parts of the side plates 12*a* and 12*b* are covered are illustrated in the example of FIGS. 1 and 2A, embodiments are not limited thereto. For example, the side plates 12*a* and 12*b* may be covered in an alternative configuration. In the example of FIGS. 1 and 2A, the position of covering can be fixed by covering being performed by the clasp fixture 40 that rotates with the non-sliding shaft 21 as a fulcrum.

The following operation is performed for the belt 62 to be removed. The clasp fixture 40 is rotated to the opposite side, and then the restraint on a movement of the belt clasp 30 in the direction opposite to the bar 14 side is released. Then, the shaft 20 is slid to the side opposite to the bar 14. As a result, the open end portion 32 of the belt clasp 30 is pulled out from the space between the bar 14 and the belt 62. The fixing of the belt 62 is released by the belt clasp 30 being rotated in the direction that is opposite to the direction in which the belt 62 overlapped in two by the convex portion 34 is pushed out from the slit 50. In other words, when the convex portion 42 of the clasp fixture 40 is removed from the belt clasp 30, operation is performed such that a finger is inserted between the belt portion 60*a* of the belt 62 and the end portion of the clasp fixture 40 that is on the side opposite to the shaft 21.

A belt is fixed as follows in the first comparative example that is illustrated in FIG. 2B. As illustrated in FIG. 2B, one end of a belt 362 is fixed with a set screw 311 to a portion 310*a* of a back plate 310 such that the belt 362 passes through a buckle 300. The other end of the belt 362 is inserted from the space between a front bar 314 and the portion 310*a* of the back plate 310 and passed through the buckle 300 through the space between a front bar 316 and a portion 310*b* of the back plate 310. As a result, the belt 362 is overlapped in the buckle 300 (back side belt portion 360*b* and front side belt portion 360*a*). At this stage, the length of the belt is adjusted so as to fit a user's waist circumference. Then, with the belt 362 overlapped in two, a belt clasp 330 is brought close to the front bar 316 side once, and then an open end portion 332 of the belt clasp 330 is pushed down to the back side beyond the front bar 314 while the part of the belt 362 overlapped in two is pushed out from a slit 350 by a convex portion 334. Subsequently, a shaft 320 is slid to the front bar 314 side. By the shaft 320 being slid in a slit 313 (slit 313*a* being illustrated as a cross section pertains here) of a side plate 312 (side plate 312*a* being illustrated as a cross section pertains here) to the front bar 314 side, the open end portion 332 of the belt clasp 330 is moved up to an end portion of the front bar 314 through the space between the front bar 314 and the back plate 310. In practice, the open end portion 332 of the belt clasp 330 is inserted between the front bar 314 and the belt 360*a*. At that time, the shaft 320 is slid until a hook 336, which is formed in the open end portion 332 of the belt clasp 330 and has a claw extending upward (toward the front surface side), penetrates the space between the front bar 314 and the back plate 310*a*. The front bar 314 catches the hook 336, and thus the shaft 320 is restrained such that the shaft 320 is incapable of sliding to the front bar 316 side. As a result, the belt clasp 330 is restrained so as to be incapable of sliding to the front bar 316 side. As a result, it is possible to prevent the open end portion 332 of the belt clasp 330 from escaping from the space between the front bar 314 and the belt 360*a*. A state where the part of the belt 362 overlapped in two is pushed out from the slit 350 by the convex portion 334 is maintained insofar as the open end portion 332 of the belt clasp 330 is incapable of escaping from the space between the front bar 314 and the belt 360*a*. Accordingly, the belt 362 can be fixed with a frictional force resulting from pressing. In the buckle 300 according to the comparative example, the belt 362 is fixed in the above manner.

In the first comparative example, the hook 336 needs to be passed between the front bar 314 and the belt 360*a*, and thus a clearance h2 between the front bar 314 and the belt 360*a* needs to be widened up to the sum of the thickness of the open end portion 332 of the belt clasp 330 and the overhanging height of the hook 336. In Embodiment 1, in contrast, the belt clasp 30 is restrained by the clasp fixture 40, and thus the hook 336 illustrated in the first comparative example is unnecessary. Accordingly, in Embodiment 1, a clearance h1 between the bar 14 and the belt portion 60*a* of the belt 62 may be ensured to such an extent that the thickness of the open end portion 32 of the belt clasp 30 can be smoothly inserted. In other words, the clearance h1 of Embodiment 1 can be smaller than the clearance h2 of the first comparative example. As a result, in Embodiment 1, a thickness H1 of the buckle 100 can be smaller than a thickness H2 of the buckle 300 of the first comparative example and the belt can be strongly fixed by a frictional force generated by the belt clasp 30 being brought into close contact in a wider area.

In view of the strength of the front bar and the like, the shaft 320 needs to be slid by at least 5 mm or so, until the hook 336 escapes from the space between the front bar 314 and the belt 360*a*, in the first comparative example. The opening length of the slit 313 (slit 313*a* being illustrated as a cross section pertains here) of the side plate 312 (side plate 312*a* being illustrated as a cross section pertains here) needs to be large and is required not to be smaller than that of the hook 336. In Embodiment 1, in contrast, the open end portion 32 of the belt clasp 30 may be inserted by at least 3 mm or so between the belt portion 60*a* of the belt 62 and the bar 14 and a movement of at least 5 mm or so for escaping from the space between the bar 14 and the belt portion 60*a* of the belt 62 is unnecessary. Accordingly, the slide-direction opening length of the slit 13 (slit 13*a* being illustrated as a cross section pertains here) of the side plate 12 (side plate 12*a* being illustrated as a cross section pertains here) can be shortened by, for example, 2 mm as compared with the first comparative example. For example, an insertion length may be open between the bar 14 and the belt portion 60*a* of the belt 62 even if the open end portion 32 of the belt clasp 30 is approximately 3 mm. As a result, the longitudinal size of the slit 13 can be reduced, and thus the length of the base body of the buckle, which is determined by the distance between end portions of the bars 14 and 16, is reduced as well.

As described above, a buckle that is capable of fixing a belt more strongly is provided according to Embodiment 1. In addition, with the buckle, the belt does not undergo any unintentional loosening attributable to an external force received by a belt clasp.

As described above, the buckle 100 according to Embodiment 1 is a buckle for a belt for Western clothes and the like that is used by being wrapped around a person's body and the buckle 100 uses a frictional force for stepless fastening position adjustment. Especially, the buckle 100 is designed such that the frictional force that is generated during the use effectively fixes the belt 62, by the distal end portion and the proximal end portion of the belt 62 being overlapped with each other and pushed into a slit-shaped gap (slit 50) by the convex portion 34 of the tilted belt clasp 30 and bending being performed so as to become convex toward the human body side, so that the distal end portion of the belt 62 is not pulled out from the buckle 100 by the tension (design maximum load) that the belt 62 receives during the use. If the height of the convex portion 34 of the belt clasp 30 is too low, the belt 62 cannot be bent sufficiently and no sufficient frictional force can be generated. If the height of the convex portion 34 of the belt clasp 30 is too high, the belt 62 cannot be operated with ease. Accordingly, a range of 3 mm to 15 mm from the surface of the open end portion 32 of the belt clasp 30 (back side surface) is preferable, and a range of 3 mm to 10 mm may be more preferable. In a case where the belt 62 is bent and the belt is a thick belt or a high-rigidity belt, the belt does not have to be pushed in significantly downward (to the back side). In the case of a thin belt or a low-rigidity belt, the belt needs to be pushed in downward (to the back side). Accordingly, more desirably, the height of the convex portion 34 of the belt clasp 30 may be designed within the above range and in accordance with the thickness or the rigidity of the belt that is used. Once the height of the convex portion 34 of the belt clasp 30 is set to that range, the belt 62 is bent after overlapping and the direction of the tension is bent at the same time, and thus the belt portion 60*a* of the belt 62 is pressed against the belt portion 60*b* of the belt 62 by the tension toward the surface side formed by chamfering of an end portion of the back plate 10*a* and mainly generating the frictional force. As a result, the frictional force is generated between the belt portion 60*b* of the belt 62 and the belt portion 60*a* of the belt 62 and it is possible to effectively stop the belt from sliding out by means of the frictional force increasing in proportion to the tension.

In Embodiment 1, the friction surface is not parallel to the direction of the tension received by the belt 62 and the distal end portion of the belt 62 does not slide out even when the belt is bent so as to become convex toward the human body side and the buckle 100 receives an external force in a direction away from the human body. In other words, when the external force in a direction away from the human body is received, the shape of a quadratic curve in the direction opposite to the quadratic curve shape in which the belt 62 is formed by the external force can be forced to the belt by the buckle 100. Accordingly, in Embodiment 1, the belt 62 is bent so as to become convex toward the human body by the buckle 100. Further, the frictional force can also be enhanced in proportion to the tension by the bending toward the human body, and thus the belt can be fixed more strongly.

As described above, in the buckle 100 according to Embodiment 1, the clasp fixture 40 is capable of preventing removal of the belt clasp 30 by restraining a movement of the belt clasp 30. Accordingly, it is possible to fix the belt with a stronger frictional force by generating friction for the belt in a wider area than in the case of the buckle illustrated in the first comparative example. Further, the belt clasp is fixed so as not to be unintentionally removed from the clasp fixture, and thus the belt can be fixed in a more reliable manner.

As described above, according to Embodiment 1, the belt can be steplessly fixed by the frictional force and it is possible to prevent unintentional belt loosening attributable to an external force other than the tension that the buckle receives. In addition, it is possible to fix the belt with a stronger frictional force by means of the friction for the belt generated in a wide area. Further, it is possible to prevent unintentional belt loosening attributable to an external force received by the clasp since the clasp is fixed with the fixture.

Embodiment 2

Described in Embodiment 1 is a configuration in which a force against reverse rotation of the clasp fixture 40 is applied by the clasp fixture 40 being rotated such that the convex portion 42 of the clasp fixture 40 is further pushed in while abutting the convex portion 42 against the shaft side end portion of the belt clasp 30 that moves with the sliding of the shaft 20. However, configurations for application of the force against the reverse rotation of the clasp fixture 40 are not limited thereto.

Figure 3A:
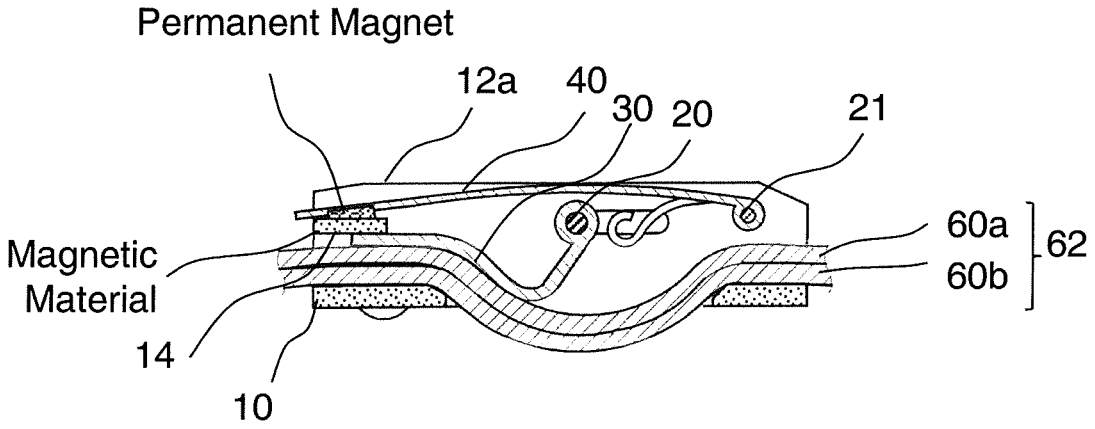
FIGS. 3A and 3B are diagrams illustrating an example of the cross-sectional configuration of a buckle for a clothing belt according to Embodiment 2 as viewed from the bottom surface direction.
Figure 3B:
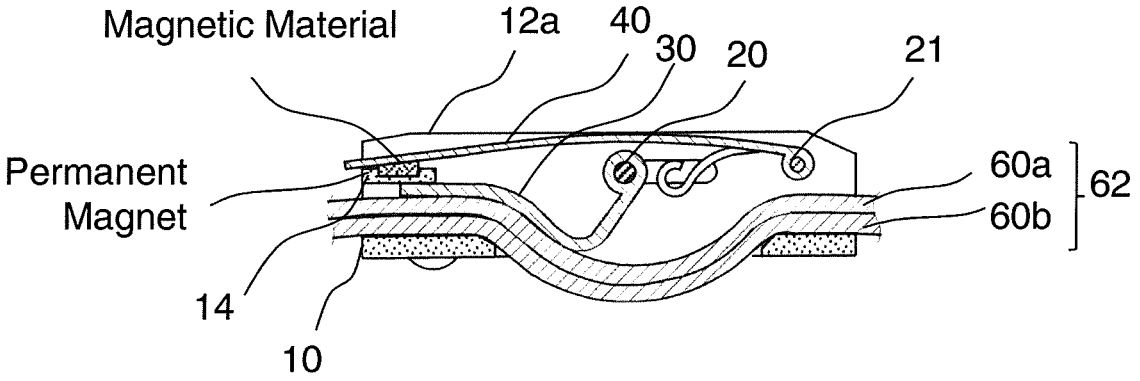

FIGS. 3A and 3B are diagrams illustrating an example of the cross-sectional configuration of a buckle for a clothing belt according to Embodiment 2 as viewed from the bottom surface direction. A perspective view seen from the front direction and illustrating an example of the configuration of the buckle for a clothing belt according to Embodiment 1 is substantially identical to FIG. 1 except for the bar 14. FIG. 3A illustrates a case where a permanent magnet is disposed on the clasp fixture 40 side. FIG. 3B illustrates a case where a permanent magnet is disposed on the bar 14 side. As illustrated in FIG. 3A, the bar 14 is made of a ferromagnetic material in part or in whole. The permanent magnet is disposed in the distal end portion of the lid part of the clasp fixture 40, at the part abutting against the bar 14 to be more specific. The suction force between the ferromagnetic material of the bar 14 and the permanent magnet of the lid part of the clasp fixture 40 causes the clasp fixture 40 and the base body 17 (bar 14) of the buckle to stick together, and a force against rotation of the clasp fixture 40 is applied as a result. Accordingly, in the example of FIG. 3A, the convex portion 42 of the clasp fixture 40 may not abut against the shaft side end portion of the belt clasp 30 as illustrated in FIG. 2A. Alternatively, the convex portion 42 of the clasp fixture 40 may abut against the shaft side end portion of the belt clasp 30. The other configurations are similar to those of Embodiment 1.

Alternatively, the distal end portion of the lid part of the clasp fixture 40 or the entire lid part of the clasp fixture 40 is made of a ferromagnetic material as illustrated in FIG. 3B. The permanent magnet is disposed on the bar 14. The suction force between the ferromagnetic material of the bar 14 and the permanent magnet of the lid part of the clasp fixture 40 causes the clasp fixture 40 and the base body 17 (bar 14) of the buckle to stick together, and a force against rotation of the clasp fixture 40 is applied as a result. Accordingly, in the example of FIG. 3A, the convex portion 42 of the clasp fixture 40 may not abut against the shaft side end portion of the belt clasp 30 as illustrated in FIG. 2A. Alternatively, the convex portion 42 of the clasp fixture 40 may abut against the shaft side end portion of the belt clasp 30. The other configurations are similar to those of Embodiment 1.

Embodiment 3

Figure 4:
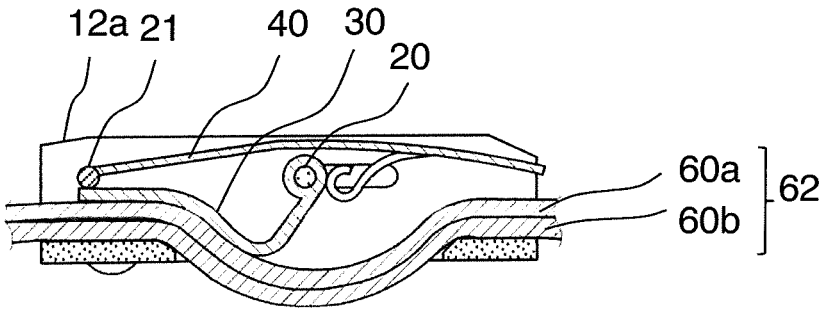
FIG. 4 is a diagram illustrating an example of the cross-sectional configuration of a buckle for a clothing belt according to Embodiment 3 as viewed from the bottom surface direction.

FIG. 4 is a diagram illustrating an example of the cross-sectional configuration of a buckle for a clothing belt according to Embodiment 3 as viewed from the bottom surface direction. A perspective view seen from the front direction and illustrating an example of the configuration of the buckle for a clothing belt according to Embodiment 1 is substantially identical to FIG. 1 except for the position of the shaft 21. The shaft 21 is also used as the bar 14 in the example of FIG. 4.

In FIGS. 1 and 4, the buckle 100 for a clothing belt (hereinafter, referred to as the buckle 100) is provided with the base body 17 of the buckle having the back plate 10 (10*a* and 10*b*) and the side plates 12*a* and 12*b*, the shaft 20 (first shaft), the belt clasp 30, the shaft 21 (second shaft), and the clasp fixture 40. The slit 50 (opening portion) is formed between the back plates 10*a* and 10*b* in the back plate 10. The slit 50 is opened with a width larger than the width of the clothing belt 62 (hereinafter, referred to as the belt 62).

The side plates 12*a* and 12*b* are connected to the two facing sides of the back plate 10 that are along the back plate 10 end in the width direction of the belt 62. The shaft 20 is disposed between the side plates 12*a* and 12*b*. The shaft 20 is supported by the side plates 12*a* and 12*b* so as to be slidable toward a direction orthogonal to the axial direction.

In Embodiment 3, the shaft 21 is disposed between the side plates 12*a* and 12*b* and supported by the side plates 12*a* and 12*b* at a position away from the slit 50 with a clearance from the plate surface of the back plate 10. The shaft 21 is supported at a position not overlapping with the slit 50. Here, for example, the shaft 21 is rotatably supported. The shaft 21 does not slide unlike the shaft 20.

The belt clasp 30 (first rotating body) is supported by the shaft 20 so as to be rotatable with the shaft 20 as a fulcrum. The belt clasp 30 is supported by the shaft 20 between the side plates 12*a* and 12*b*. The belt clasp 30 is formed so as to have the convex portion 34 (first convex portion) that becomes convex to the back plate 10 side (back side) in a case where the belt clasp 30 is rotated to the shaft 21 side. The belt clasp 30 is configured such that the open end portion 32 of the belt clasp 30 on the side opposite to the side supported by the shaft 20 can be disposed between the shaft 21 and the back plate 10 (10*a*) by the shaft 20 being slid to the shaft 21 side in a state where the convex portion 34 is rotated toward the slit 50 of the back plate 10.

The clasp fixture 40 (second rotating body) is supported by the shaft 21 so as to be rotatable with the shaft 21 as a fulcrum. In the example of FIG. 4, the position of the axis of rotation of the clasp fixture 40 is opposite to that of FIG. 2A. The clasp fixture 40 is supported by the shaft 21 between the side plates 12*a* and 12*b*. The clasp fixture 40 is formed so as to have the convex portion 42 (second convex portion) that becomes convex to the back plate 10 side (back side) in a case where the clasp fixture 40 is rotated to the shaft 20 side. The clasp fixture 40 is configured such that a movement of the belt clasp 30 in the direction opposite to the shaft 21 side can be hindered by the convex portion 42 in a state where the clasp fixture 40 is rotated so as to be push the convex portion 42 in toward the slit 50 of the back plate 10.

As illustrated in FIGS. 1 and 4, the belt portion 60*b* of the one end of the belt 62 is fixed with the set screw 11 to the back plate 10*a* on the shaft 21 side with respect to the slit 50 such that the belt 62 passes through the base body 17 of the buckle. The other end portion 60*a* of the belt 62 is inserted from the space between the shaft 21 and the back plate 10 and passed through the base body 17 of the buckle above the back plate 10. As a result, the belt 62 is overlapped in two (back side belt portion 60*b* and front side belt portion 60*a*) in the base body 17 of the buckle. The set screw 11 may be replaced with another fixing method such as a rivet.

At this stage, the length of the belt is adjusted so as to fit a user's waist circumference. Then, with the belt 62 overlapped in two, the belt clasp 30 is tilted and the convex portion 34 is pushed in toward the slit 50. Then, the shaft 20 is slid once in the direction opposite to the shaft 21 side in the slit 13 (slit 13*a* being illustrated as a cross section pertains here) of the side plate 12 (side plate 12*a* as a cross section pertains here). Then, the open end portion 32 is pushed in downward from the shaft 21, the part of the belt 62 overlapped in two is pushed out from the slit 50 by the convex portion 34, and then the shaft 20 is slid in the slit 13 (slit 13*a* being illustrated as a cross section pertains here) of the side plate 12 (side plate 12*a* as a cross section pertains here) to the shaft 21 side in that state. In other words, the open end portion 32 of the belt clasp 30 is moved to the space between the shaft 21 and the belt 62 by the shaft 20 being slid to the shaft 21 side in a state where the belt 62 overlapped in two by the convex portion 34 is bent so as to be pushed out from the slit 50 as a result of rotation of the belt clasp 30. In other words, the belt clasp 30 is disposed so as to be capable of rising and falling around the shaft 20 perpendicular to the pair of side plates 12*a* and 12*b*. The convex portion 34 has a configuration in which the overlapped belt 62 becomes convex by, for example, 3 mm to 10 mm toward the slit 50 formed between the back plates 10*a* and 10*b* when the belt clasp 30 is tilted and the open end portion 32 of the belt clasp 30 is moved to the space between the shaft 21 and the back plate 10*a* by the shaft 20 being slid to the shaft 21 side. In other words, the open end portion 32 of the belt clasp 30 is moved so as to be capable of being disposed between the shaft 21 and the belt portion 60*a* of the belt 62.

Next, in a state where the clasp fixture 40 is rotated until the convex portion 42 of the clasp fixture 40 is positioned on the path of the movement of the shaft side end portion of the belt clasp 30 that results from the sliding of the shaft 20 with the convex portion 34 of the belt clasp 30 and the open end portion 32 of the belt clasp 30 in close contact with the surface of the belt 62, a force against the rotation of the clasp fixture 40 is applied, and then the belt 62 is fixed by a movement of the belt clasp 30 in the direction opposite to the shaft 21 side being restrained. In the example of FIGS. 1 and 4, the clasp fixture 40 is rotated such that the convex portion 42 of the clasp fixture 40 is further pushed in while abutting against the shaft side end portion of the belt clasp 30 as the shaft 20 is slid, and thus a force against reverse rotation of the clasp fixture 40 is applied. As a result, the belt 62 is fixed by a movement of the belt clasp 30 in the direction opposite to the shaft 21 side being restrained. In other words, the clasp fixture 40 rotatably supported by the shaft 21 is rotated so as to cover the belt clasp from above, the convex portion 42 of the clasp fixture 40 formed of an elastic body is inserted beside the clasp, and the convex portion 42 is engaged with the shaft side end portion of the belt clasp.

Also in the example of FIG. 4, the clasp fixture 40 performs covering so as to cover the base body 17 of the buckle with a clearance allowing entering of a user's finger provided between the belt portion 60*a* of the belt 62 and the end portion on the side that is opposite to the shaft 21. As a result, it is possible to achieve an appearance suitable for business clothes and ceremonial dresses and achieve a design of completely original appearance by covering a lid from above the clasp that is unique in appearance also in the buckle for rotatable clasp-based belt fixing.

The following operation is performed for the belt 62 to be removed. The clasp fixture 40 is rotated to the opposite side, and then the restraint on a movement of the belt clasp 30 in the direction opposite to the shaft 21 side is released. Then, the shaft 20 is slid to the side opposite to the shaft 21. As a result, the open end portion 32 of the belt clasp 30 is pulled out from the space between the shaft 21 and the belt 62. The fixing of the belt 62 is released by the belt clasp 30 being rotated in the direction that is opposite to the direction in which the belt 62 overlapped in two by the convex portion 34 is pushed out from the slit 50. In other words, when the convex portion 42 of the clasp fixture 40 is removed from the belt clasp 30, operation is performed such that a finger is inserted from the opening portion on the back side of the clasp fixture 40. In this case, in Embodiment 3, the position of the axis of rotation of the clasp fixture 40 is opposite to that of the example of FIG. 2A.

Embodiment 4

Figure 5:
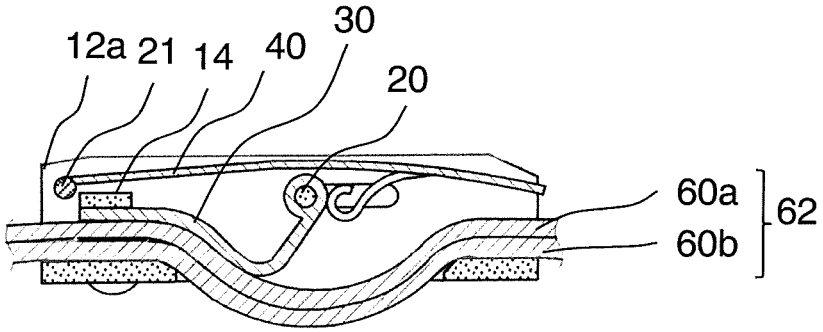
FIG. 5 is a diagram illustrating an example of the cross-sectional configuration of a buckle for a clothing belt according to Embodiment 4 as viewed from the bottom surface direction.

FIG. 5 is a diagram illustrating an example of the cross-sectional configuration of a buckle for a clothing belt according to Embodiment 4 as viewed from the bottom surface direction. A perspective view seen from the front direction and illustrating an example of the configuration of the buckle for a clothing belt according to Embodiment 1 is substantially identical to FIG. 1 except for the position of the shaft 21. Illustrated in the example of FIG. 5 is a case where the position of the shaft 21 is outside the bar 14. Accordingly, in the example of FIG. 5, the position of the axis of rotation of the clasp fixture 40 is opposite to that of FIG. 2A. The other configurations are similar to those of Embodiment 1.

Embodiments have been described with reference to specific examples. Embodiments are not limited to the specific examples.

Every buckle for a clothing belt that is provided with the elements of embodiments and can be appropriately changed in design by those skilled in the art is included in the scope of embodiments.

Additional advantages and modification will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A buckle for a clothing belt comprising:

a base body including a back plate in which an opening portion is formed, a first side plate connected to one of two facing sides of the back plate, a second side plate connected to another one of the two facing sides of the back plate, and a bar extending from one side of the first and second side plates to the other side of the first and second side plates at a position away from the opening portion with a clearance from a plate surface of the back plate;

a first shaft disposed between the first and second side plates and supported by the first and second side plates so as to be slidable toward a direction orthogonal to an axial direction;

a first rotating body supported by the first shaft so as to be rotatable with the first shaft as a fulcrum and formed so as to have a first convex portion, an open end portion of the first rotating body on a side opposite to a side supported by the first shaft being capable of being disposed between the bar and the back plate by making the first shaft slide to the bar side in a state where the first convex portion is rotated toward the opening portion of the back plate;

a second shaft disposed between the first and second side plates and supported by the first and second side plates; and a second rotating body supported by the second shaft so as to be rotatable with the second shaft as a fulcrum, formed so as to have a second convex portion, and capable of hindering a movement of the first rotating body in a direction opposite to the bar side with the second convex portion in a state where the second convex portion is rotated so as to be pushed in toward the opening portion of the back plate, wherein an end portion of the clothing belt is fixed to the back plate on the bar side so as to straddle the opening portion, the clothing belt is disposed so as to be passed through the base body in a state of being overlapped in two, the open end portion of the first rotating body is moved to a space between the bar and the clothing belt by making the first shaft slid to the bar side in a state where the clothing belt overlapped in two is bent so as to be pushed out from the opening portion by the first convex portion as a result of rotation of the first rotating body, a movement of the first rotating body in a direction opposite to the bar side is restrained by making a force against rotation of the second rotating body apply in a state where the second rotating body is rotated until the second convex portion of the second rotating body is positioned on a path of movement of a shaft side end portion of the first rotating body that moves with a sliding of the first shaft, with the first convex portion in close contact with a surface of the clothing belt and the open end portion of the first rotating body in close contact with a surface of the clothing belt, the clothing belt is fixed by a restraint on a movement of the first rotating body in the direction opposite to the bar side, the restraint on the movement of the first rotating body in the direction opposite to the bar side is released by making the second rotating body rotate to an opposite side, the open end portion of the first rotating body is pulled out from the space between the bar and the clothing belt by making the first shaft slide in the direction opposite to the bar side, and the fixing of the clothing belt is released by making the first rotating body rotate in a direction opposite to a direction in which the clothing belt overlapped in two is pushed out from the opening portion by the first convex portion.

2. A buckle for a clothing belt comprising:

a base body including a back plate in which an opening portion is formed, a first side plate connected to one of two facing sides of the back plate, and a second side plate connected to another one of the two facing sides of the back plate;

a first shaft disposed between the first and second side plates and supported by the first and second side plates so as to be slidable toward a direction orthogonal to an axial direction;

a second shaft disposed between the first and second side plates and supported by the first and second side plates at a position away from the opening portion with a clearance from a plate surface of the back plate;

a first rotating body supported by the first shaft so as to be rotatable with the first shaft as a fulcrum and formed so as to have a first convex portion, an open end portion of the first rotating body on a side opposite to a side supported by the first shaft being capable of being disposed between the second shaft and the back plate by making the first shaft slide to the second shaft side in a state where the first convex portion is rotated toward the opening portion of the back plate; and a second rotating body supported by the second shaft so as to be rotatable with the second shaft as a fulcrum, formed so as to have a second convex portion, and capable of hindering a movement of the first rotating body in a direction opposite to the second shaft side with the second convex portion in a state where the second rotating body is rotated so as to push the second convex portion in toward the opening portion of the back plate, wherein an end portion of the clothing belt is fixed to the back plate on the second shaft side so as to straddle the opening portion, the clothing belt is disposed so as to be passed through the base body in a state of being overlapped in two, the open end portion of the first rotating body is moved to a space between the second shaft and the clothing belt by making the first shaft slide to the second shaft side in a state where the clothing belt overlapped in two is bent by the first convex portion so as to be pushed out from the opening portion as a result of rotation of the first rotating body, a movement of the first rotating body in the direction opposite to the second shaft side is restrained by making a force against rotation of the second rotating body apply in a state where the second rotating body is rotated until the second convex portion of the second rotating body is positioned on a path of movement of a shaft side end portion of the first rotating body that moves with a sliding of the first shaft, with the first convex portion in close contact with a surface of the clothing belt and the open end portion of the first rotating body in close contact with a surface of the clothing belt, the clothing belt is fixed by a restraint on a movement of the first rotating body in the direction opposite to the second shaft side, the restraint on the movement of the first rotating body in the direction opposite to the second shaft side is released by making the second rotating body rotate to the opposite side, the open end portion of the first rotating body is pulled out from the space between the second shaft and the clothing belt by making the first shaft slide to the direction opposite to the second shaft side, and the fixing of the clothing belt is released by making the first rotating body rotate in a direction opposite to a direction in which the clothing belt overlapped in two is pushed out from the opening portion by the first convex portion.

3. The buckle according to claim 1, wherein a force against reverse rotation of the second rotating body is applied, the movement of the first rotating body in the direction opposite to the bar side is restrained, and the clothing belt is fixed as a result by making the second rotating body rotate such that the second convex portion of the second rotating body is further pushed in while abutting the second convex portion against the shaft side end portion of the first rotating body that moves with a slide of the first shaft.

4. The buckle according to claim 1, wherein the bar has a ferromagnetic material, a permanent magnet is disposed in the second rotating body, and the force against rotation of the second rotating body is applied by a suction force between the ferromagnetic material of the bar and the permanent magnet causing the second rotating body and the bar to stick together.

5. The buckle according to claim 1, wherein the second rotating body has a ferromagnetic material, a permanent magnet is disposed in the bar, and a force against rotation of the second rotating body is applied by a suction force between the ferromagnetic material of the second rotating body and the permanent magnet causing the second rotating body and the bar to stick together.

6. The buckle according to claim 2, wherein a force against reverse rotation of the second rotating body is applied, the movement of the first rotating body in the direction opposite to the second shaft side is restrained, and the clothing belt is fixed as a result by making the second rotating body rotate such that the second convex portion of the second rotating body is further pushed in while abutting the second convex portion against the shaft side end portion of the first rotating body that moves with a slide of the first shaft.

* * * * *